US008544435B2

(12) United States Patent
Prior

(10) Patent No.: US 8,544,435 B2
(45) Date of Patent: Oct. 1, 2013

(54) HYDRAULIC VALVE LIFTER PUSHROD SEAL

(75) Inventor: Gregory P. Prior, Birmingham, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 25 days.

(21) Appl. No.: 13/283,934

(22) Filed: Oct. 28, 2011

(65) Prior Publication Data

US 2013/0104825 A1 May 2, 2013

(51) Int. Cl.
*F01L 1/14* (2006.01)

(52) U.S. Cl.
USPC ..... 123/90.55; 123/90.52; 123/90.43

(58) Field of Classification Search
USPC ..... 123/90.55, 90.52, 90.59, 90.43
See application file for complete search history.

(56) References Cited

U.S. PATENT DOCUMENTS

| | | | | |
|---|---|---|---|---|
| 2,873,729 | A | 2/1959 | Slooten | |
| 3,144,010 | A | 8/1964 | Slooten | |
| 4,584,976 | A * | 4/1986 | Hillebrand | 123/90.55 |
| 4,807,575 | A * | 2/1989 | Litwinchuk et al. | 123/90.55 |
| 6,318,324 | B1 * | 11/2001 | Koeroghlian et al. | 123/90.55 |
| 6,684,415 | B1 * | 2/2004 | Kozono | 4/211 |
| 2006/0130793 | A1 | 6/2006 | Rutsey | |
| 2006/0169236 | A1 | 8/2006 | Karbstein et al. | |

* cited by examiner

*Primary Examiner* — Zelalem Eshete
(74) *Attorney, Agent, or Firm* — Frederick A. Krieger

(57) ABSTRACT

A hydraulic valve lifter apparatus including a seal at the interface of a pushrod seat and a pushrod is provided herein. In one form, the hydraulic valve lifter apparatus includes a body, a piston slidably disposed within the body including a pushrod seat for contacting a pushrod, and a seal located between the pushrod seat and the pushrod.

16 Claims, 5 Drawing Sheets

HYDRAULIC VALVE LIFTER PUSHROD SEAL

FIELD

The present disclosure relates to a hydraulic valve lifter and, more particularly, to a hydraulic valve lifter having a seal positioned relative to a pushrod seat.

BACKGROUND

Hydraulic valve lifters (also known as hydraulic lash adjusters "HLAs" or hydraulic tappets) are used to maintain a valve clearance in internal combustion engines. Maintaining valve clearance is important as it reduces noise and allows an engine to run more efficiently. Hydraulic valve lifters function by transferring energy from the actuating cam lobe to the pushrod and ultimately the rocker arm via hydraulic oil in a pressure chamber. The hydraulic valve lifter changes length by varying the oil level in the system. Oil is added to the hydraulic valve lifter to elongate the system and oil is allowed to escape to shorten the system. By changing length, the lifter maintains contact between the elements and thus eliminates any lash or gaps that would result in unwanted noise.

When the valve train includes hydraulic valve lifters and pushrods it is possible to supply oil from the rocker arm or rocker arm shaft to the hydraulic valve lifters through the pushrods. This allows the oil inside the pushrod to form part of the low pressure reservoir and decreases the size of the lower pressure chamber in the hydraulic valve lifters allowing for a more compact assembly. In this arrangement, oil can leak from the hydraulic valve lifters and the pushrod. When this occurs, the hydraulic valve lifters fail to maintain a desirable valve clearance, which may result in undesirable valve operation such as lash and noise during valve operation. This problem is aggravated when the hydraulic valve lifters and pushrods are oriented in near horizontal arrangements as there is greater opportunity for oil to drain from the hydraulic valve lifters when they are not in operation. Therefore, there is need for improvement in the art.

SUMMARY

In one form, the present disclosure provides a hydraulic valve lifter apparatus that includes a body, a piston slidably disposed within the body including a pushrod seat for contacting a pushrod, and a seal located between the pushrod seat and the pushrod.

In another form of the hydraulic valve lifter apparatus, the seal includes a contact area about a passage through the pushrod seat. The contact area includes a portion of the pushrod seat in contact with a portion of a tip of the pushrod.

In another form, the hydraulic valve lifter apparatus includes a first fluid chamber having an interior portion configured to guide fluid toward a passage through the pushrod seat.

In another form, the hydraulic valve lifter apparatus includes a first fluid chamber having fluid-directing insert therein configured to guide fluid toward a passage through the pushrod seat.

In another form of the hydraulic valve lifter apparatus, the seal is connected to the fluid-directing insert through a plurality of spaced apart holes in the piston.

In one form of the hydraulic valve lifter apparatus, the seal is or includes an o-ring.

In another form, the present disclosure provides a valve train apparatus comprising a hydraulic valve lifter including a pushrod seat, a hollow push rod including a spherical tip and a seal located between the pushrod seat and the spherical tip of the pushrod.

Further areas of applicability of the present disclosure will become apparent from the detailed description, drawings and claims provided hereinafter. It should be understood that the detailed description, including disclosed embodiments and drawings, are merely exemplary in nature, intended for purposes of illustration only, and are not intended to limit the scope of the invention, its application or use. Thus, variations that do not depart from the gist of the invention are intended to be within the scope of the invention.

DETAILED DESCRIPTION

Figure 3:
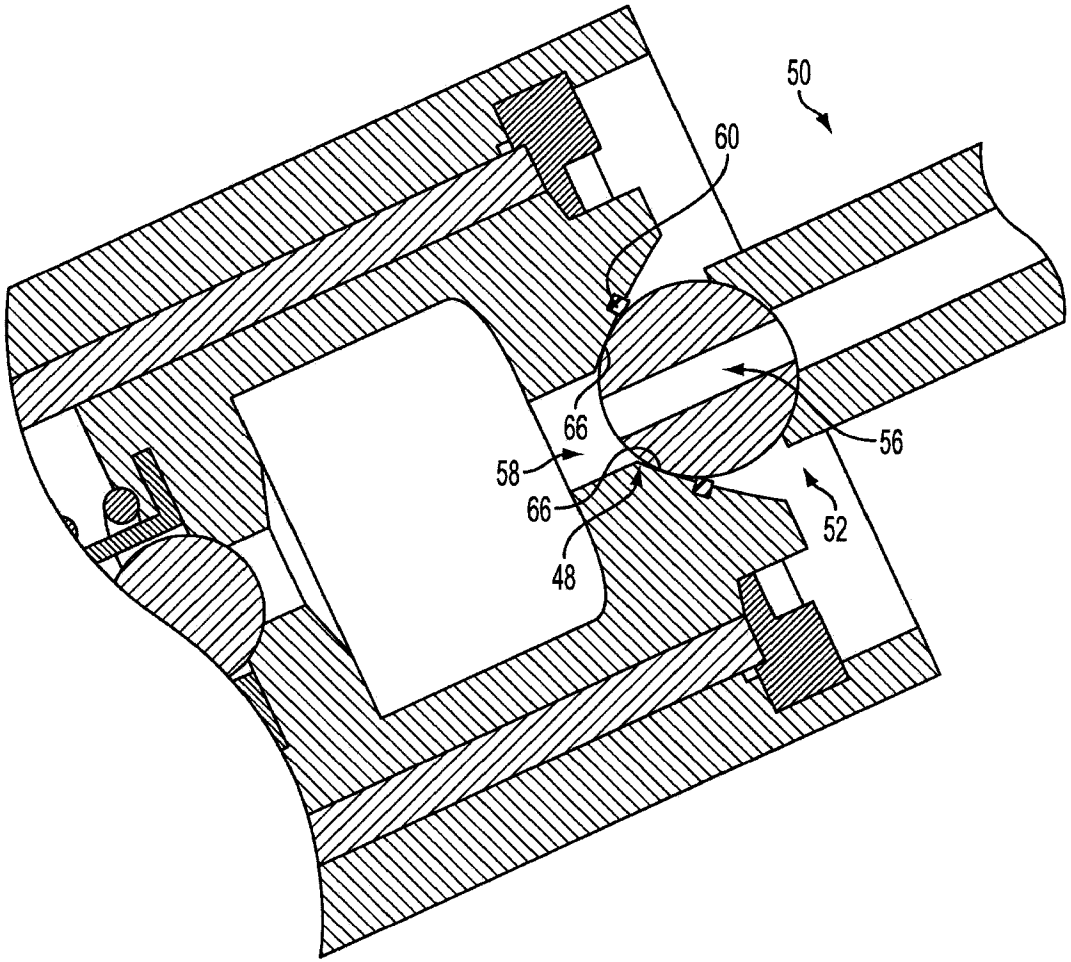
FIG. 3 is an enlarged section view of a portion of the hydraulic valve lifter of FIG. 2.
Figure 4:
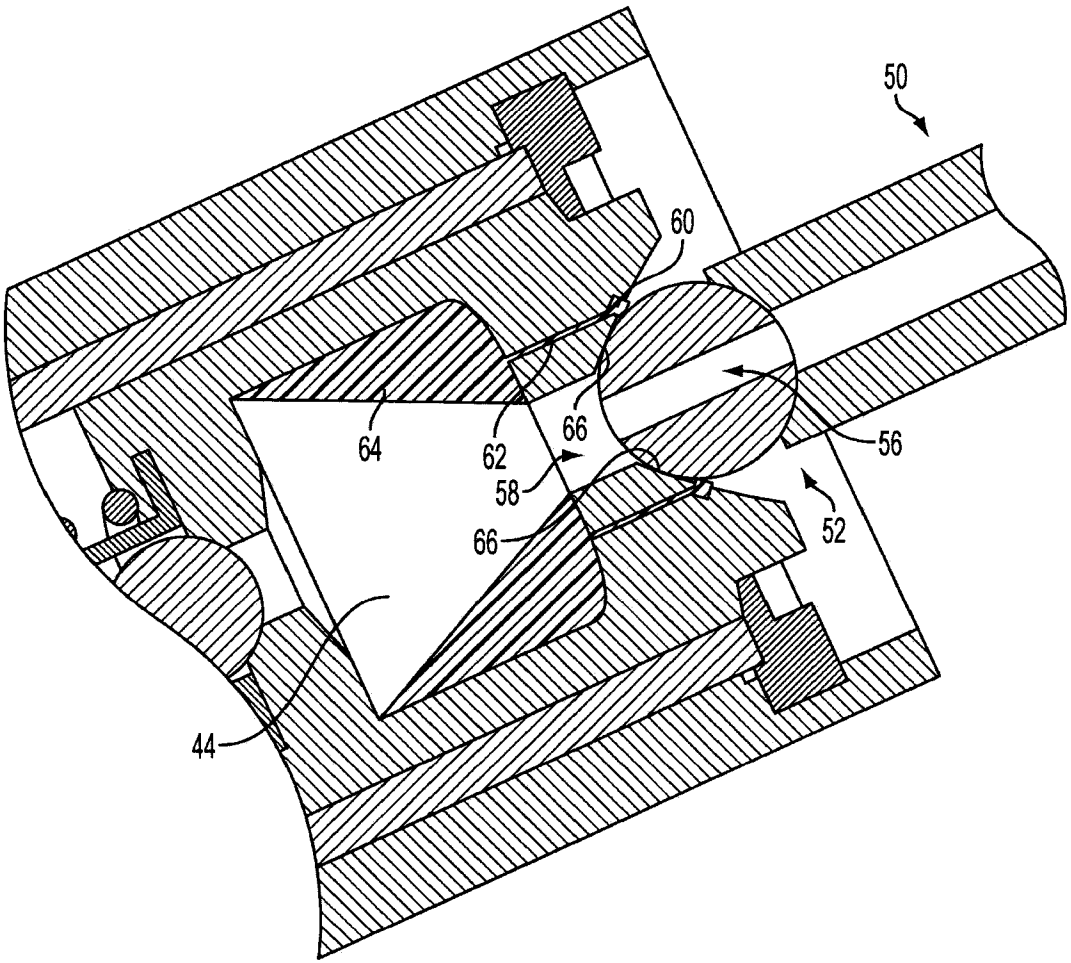
FIG. 4 is a section view of a portion of another exemplary embodiment of hydraulic valve lifter of the present disclosure.
Figure 5:
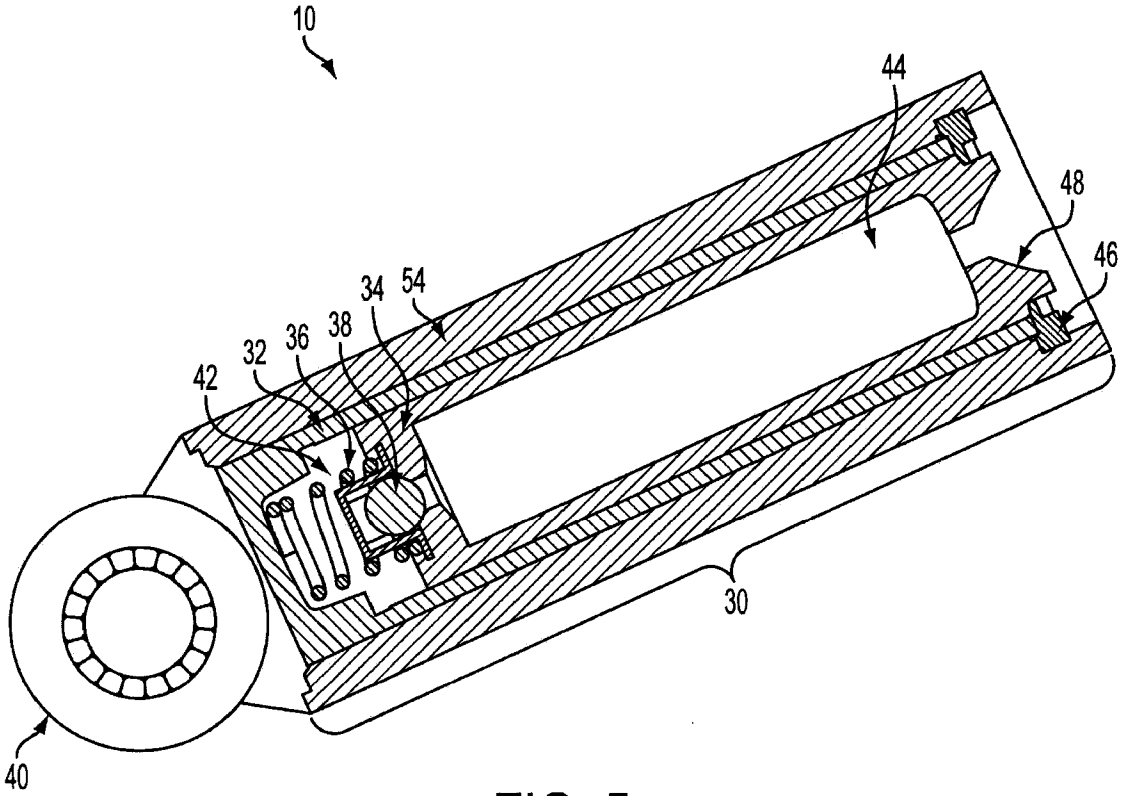
FIG. 5 is a section view of another hydraulic valve lifter.

Referring now to the drawings, FIGS. 1-5, illustrate embodiments of apparatus of a hydraulic valve lifter 10 according to the present disclosure for use with vehicle valve train apparatus. The exemplary embodiments disclosed herein of hydraulic valve lifter are suitable for use for hydraulic valve lifters and pushrods orientated in near horizontal arrangements, for example, 15 degree installed from horizontal. The hydraulic valve lifter 10 includes a multi-displacement system (MDS) section 20, which allows for lost motion in a multi-displacement system to selectively disengage cylinders during operation to improve fuel efficiency. The hydraulic valve lifter 10 also includes a hydraulic lash adjuster (HLA) section 30 and a roller 40. When installed on an engine, the roller 40 contacts a cam (not shown) that controls valve actuation. In fact, while the present disclosure is shown on a hydraulic valve lifter 10 that includes an MDS section 20, the same principles disclosed herein can be embodied on a hydraulic valve lifter that does not include an MDS section 20. For example, a hydraulic valve lifter 10 without an MDS section 20 is shown in FIG. 5.

The hydraulic valve lifter 10 includes a main body 54 into which the other components are installed. The HLA section 30 includes an HLA body 32, which is installed in the main body 54. A spring 36, a ball valve 38 and a piston 34 are located inside the HLA body 32. The HLA body 32 and the piston 34 are retained within the main body 54 by a ring 46. Although the ring 46 is shown as a single ring it is also possible to use two separate rings, one to retain the HLA body 32 and another to retain the piston 34.

The piston 34, in combination with the HLA body 32, defines a high pressure chamber 42. The piston 34 is slidably displaced inside the HLA body 32 such that the volume of the high pressure chamber 42 varies depending upon the position of the piston 34. The piston 34 includes a low pressure chamber 44 which is in fluid communication with the high pressure chamber 42 by way of the ball valve 38. The piston 34 also includes a pushrod seat 48. In this embodiment, the pushrod seat has a tapered surface that is generally parabolic in shape for interfacing with a pushrod.

Figure 1:
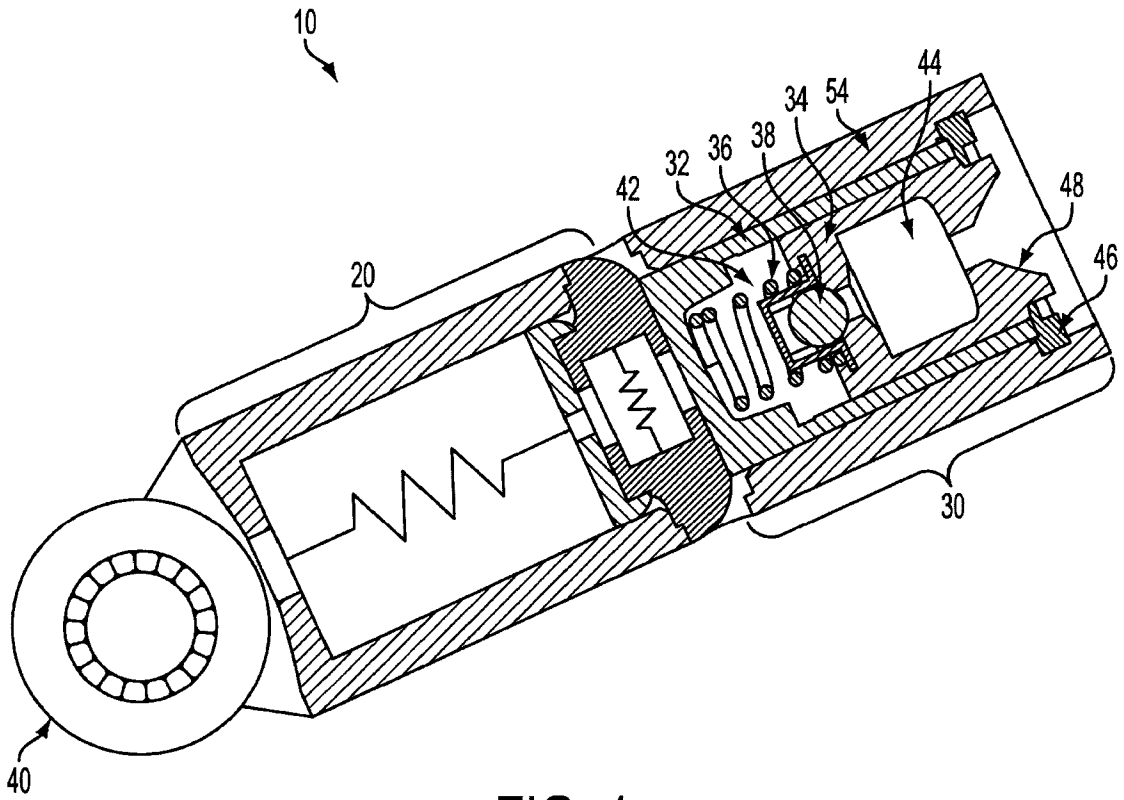
FIG. 1 is a section view of a hydraulic valve lifter.
Figure 2:
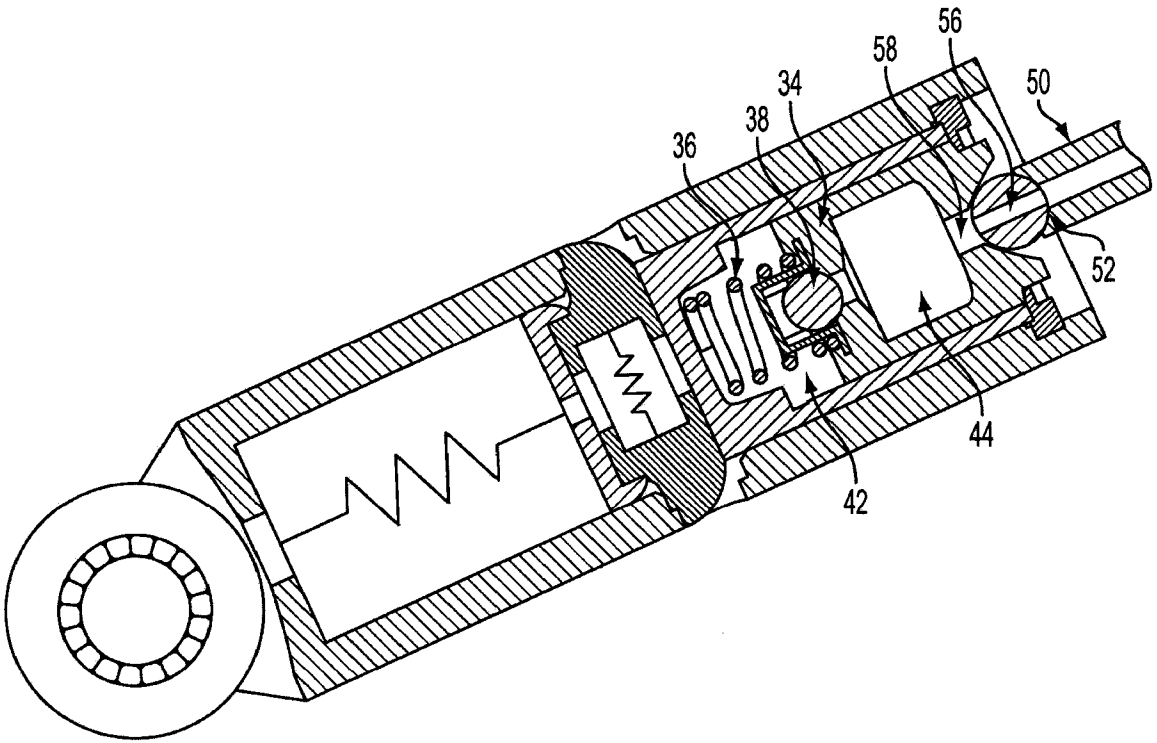
FIG. 2 is a section view of a hydraulic valve lifter and the end of a pushrod in accordance with an exemplary embodiment of the present disclosure.

In an exemplary embodiment as seen in FIG. 2, a pushrod 50 includes a spherical tip 52 that interfaces with the hydraulic valve lifter 10 at the pushrod seat 48. The pushrod 50 is hollow and receives oil from a rocker arm or rocker arm shaft (not shown). The oil flows through an aperture 56 of the spherical tip 52 of the pushrod 50 and into the low pressure chamber 44 via a passage 58 through the pushrod seat. Thus, the interior volume of the pushrod 50 in combination with the low pressure chamber 44 and the aperture 56 in the spherical tip 52 form a low pressure reservoir. It is generally desirable to maintain a minimum volumetric ratio between the low pressure chamber 44 and the high pressure chamber 42 in order to supply enough oil under changing conditions. The combination of the interior volume of the pushrod 50 and the low pressure chamber 44 allows for a smaller low pressure chamber while still providing sufficient oil to the hydraulic valve lifter 10. This results in a smaller overall component size.

The typical mechanism by which the hydraulic valve lifter maintains zero clearance under fluctuating conditions is now discussed with reference to FIG. 2. Valve train components fluctuate due to many factors and in particular due to size changes in components resulting from temperature fluctuation. Prior to the introduction of hydraulic valve lifters, it was necessary to provide some clearance in the valve train to account for expansion that occurs as the temperature increases. Hydraulic valve lifters eliminate the need for this clearance and allow for some minimum predetermined clearance, and in some embodiments substantially zero clearance, by varying the length of the valve train as conditions change.

As components expand, the pushrod exerts a force on the piston 34 compressing the spring 36 and shortening the effective length of the hydraulic valve lifter 10. As the spring 36 is compressed and the piston 34 slides into the HLA body 32 a small amount of oil escapes from the high pressure chamber 42 between the piston 34 and the HLA body 32. This lost oil drains to a collection point (not shown) and ultimately recirculates through the engine.

As components contract, the pushrod 50 exerts less force on the piston 34 and the spring 36 will bias the piston 34 toward the ring 46. As this occurs, the high pressure chamber 42 region becomes larger, decreasing the pressure in the high pressure chamber 42. The decreased pressure allows the ball valve 38 to open allowing oil to flow from the low pressure chamber 44 into the high pressure chamber 42. The low pressure chamber 44 is simultaneously filled with oil, which flows from the pushrod 50 through the spherical tip 52 and into the low pressure chamber 44. Thus, under an ideal operating condition both the low pressure chamber 44 and the high pressure chamber 42 remain substantially full of oil.

If air is present in the high pressure chamber 42, the hydraulic valve lifter 10 may not be able to maintain a desirable minimal clearance, which may result in lash (undesirable clearance between valve train components). This may result in noise (e.g. a tick sound) during hydraulic valve lifter operation. The lash occurs because the air in the system is more compressible relative to the oil and thus the hydraulic valve lifter 10 may not be able to effectively transfer motion from the cam to the pushrod. The lash and resultant noise may persist until the air is purged from the system, due to repeated motion of the piston 34, as both chambers fill with oil. For these reasons, it is desirable to prevent leakage of oil from the hydraulic valve lifter 10 and to prevent air from entering the hydraulic valve lifter 10.

Air can enter the high pressure chamber 42 when the valve is not actuated for prolonged periods of time. During shut down oil can leak from the low pressure chamber 44 at the interface of the spherical tip 52 and the pushrod seat 48, allowing air to enter the low pressure chamber 44. Then at start up, when the high pressure chamber 42 draws oil from the low pressure chamber 44, a vortex can result pulling air from the low pressure chamber 44 into the high pressure chamber 42. Oil leakage can occur when there is an improper seal between the spherical tip 52 and the pushrod seat 48, allowing oil to leak from chamber 44 and/or the aperture 56 in the spherical tip to an exterior region about the spherical tip and pushrod. As discussed below relative to FIGS. 3 and 4, the hydraulic valve lifter 10 of the present disclosure includes a seal 60 at the interface between the pushrod seat 48 and the spherical tip 52 to prevent oil leakage and air ingress into the low pressure chamber 44 from the exterior region, to reduce or minimize an amount of air that may enter the high pressure chamber 42 upon start up or otherwise during valve lifter operation.

In an exemplary embodiment as seen in FIG. 3, the disclosed hydraulic valve lifter 10 includes a seal 60 at the interface of the pushrod seat 48 and the spherical tip 52. The seal 60 can be a standard o-ring or other type of seal. As opposed to metal to metal contact at the pushrod seat/spherical tip interface, the seal 60 provides a level of compliance and promotes a desirable sealing condition at that location during various operating conditions, including when the engine is not running. The seal 60 is configured to promote that oil will not leak from the low pressure chamber 44 to the exterior region of the spherical tip and to minimize or prevent air from entering the low pressure reservoir from the exterior region. Preferably the groove (not labeled), that receives seal 60, and the seal 60 are configured and positioned such that the seal is compressed slightly when the spherical tip 52 is in contact with the pushrod seat 48. In an exemplary embodiment, the seal may also be configured so the spherical tip 52 and the pushrod seat 48 may be in contact along contact area 66 about passage 56, where both seal 60 and the contact area 66 provide a desirable sealing effect between the low pressure reservoir and the exterior region. Here, the contact area 66 is a portion of the pushrod seat about the passage in contact with a portion (e.g. here the spherical tip) of the tip of the pushrod. In one embodiment, seal 60 may be positioned and configured, e.g. slightly adjacent, above, the contact area 66, to minimize or prevent leakage if the contact area 66 does not to provide a desirable seal between the low pressure reservoir and the exterior region. In certain exemplary embodiments, at least a portion of the pushrod seat includes a surface complimentary to a corresponding portion of a surface of the tip of the pushrod, here a corresponding portion of the surface of the spherical tip. In certain embodiments, the complimentary surfaces together with the seal ring, like an o-ring, form the seal device to minimize oil and air leakage.

FIG. 4 illustrates another exemplary embodiment of a hydraulic valve lifter of the present disclosure. In addition to the seal 60, FIG. 4 shows a fluid-directing insert 64 located in the low pressure chamber 44. For example, the fluid-directing insert may be configured to guide fluid such as bubbles of air in a predetermined direction. In an exemplary embodiment the fluid-directing insert 64 is a tapered ring to guide air present in the low pressure chamber 44 toward the pushrod 50 such that the low pressure chamber 44 remains substantially filled with oil. The fluid-directing insert 64 may be connected to the seal 60 through a plurality of spaced apart holes 62 in the piston 34. In another embodiment, the fluid-directing insert 64 and the seal 60 may form a single part. One way to achieve this one-piece configuration is to insert mold the fluid-directing insert 64 and the seal 60 integral with the piston 34. This may be achieved by positioning the piston 34 in a mold and then injecting the seal material into the mold forming the fluid-directing insert 64 and the seal 60. While other techniques are also contemplated, forming the seal 60 and the fluid-directing insert 64 as a single piece may provide that the fluid-directing insert 64 retains and locates the seal 60 at the pushrod seat 48 such that the seal 60 is less likely to disengage during assembly or valve lifter operation.

In another exemplary embodiment, the fluid-directing insert 64 can also be formed as a separate element from the seal 60 or the low pressure chamber 44 can be shaped to achieve the fluid guiding effect without adding an additional element. This may be achieved by forming the low pressure chamber 44 with tapered sides similar in shape to the fluid-directing insert 64 such that an interior wall of the low pressure chamber 44 guides fluid toward the pushrod 50.

What is claimed is:

1. A hydraulic valve lifter apparatus comprising:
- a body;
- a piston slidably disposed within the body and including a pushrod seat for contacting a pushrod;
- a seal located between the pushrod seat and the pushrod;
- a first fluid chamber located within the piston;
- a second fluid chamber defined by the body and the piston; and
- a fluid-directing insert located in the first fluid chamber,
- wherein the first fluid chamber is in fluid communication with the second fluid chamber, and
- wherein the first fluid chamber is in fluid communication with the pushrod seat by way of a passage through the pushrod seat.

2. The hydraulic valve lifter apparatus of claim 1, wherein the seal is configured to have contact at the interface of the pushrod seat and a tip of the pushrod.

3. The hydraulic valve lifter apparatus of claim 1, further comprising: a ball valve located between the first fluid chamber and the second fluid chamber.

4. The hydraulic valve lifter apparatus of claim 1, wherein the first fluid chamber is tapered to guide fluid toward the passage through the pushrod seat.

5. The hydraulic valve lifter apparatus of claim 1, wherein the fluid-directing insert is configured to guide fluid toward the passage through the pushrod seat.

6. The hydraulic valve lifter apparatus of claim 1, wherein the fluid-directing insert comprises a tapered ring.

7. The hydraulic valve lifter apparatus of claim 1, wherein the fluid-directing insert is connected to the seal through holes in the piston.

8. The hydraulic valve lifter apparatus of claim 1, wherein the fluid-directing insert and the seal form a unitary structure.

9. The hydraulic valve lifter apparatus of claim 1, wherein the seal comprises an o-ring.

10. A valve train apparatus comprising:
- a hydraulic valve lifter including a pushrod seat;
- a hollow push rod including a spherical tip; and
- a seal located between the pushrod seat and the spherical tip of the pushrod;
- wherein the hydraulic valve lifter further includes a body and a piston slidably disposed within the body, wherein the pushrod seat is located on the piston;
- wherein the first fluid chamber is in fluid communication with the second fluid chamber;
- wherein the first fluid chamber is in fluid communication with the pushrod seat by way of a passage through the pushrod seat, and
- wherein the hydraulic valve lifter further includes a fluid-directing insert located in the first fluid chamber.

11. The valve train apparatus of claim 10, wherein the valve train is configured to allow oil to flow from the hollow pushrod through the spherical tip into the first fluid chamber by way of the passage through the pushrod seat.

12. The valve train apparatus of claim 11, wherein the seal includes a contact area between the pushrod seat and the spherical tip.

13. The valve train apparatus of claim 10, wherein the fluid-directing insert is configured to guide fluid toward the passage through the pushrod seat.

14. The valve train apparatus of claim 10, wherein the fluid-directing insert is connected to the seal through holes in the piston.

15. The valve train apparatus of claim 10, wherein the fluid-directing insert and the seal form a unitary structure.

16. A hydraulic valve lifter apparatus comprising:
- a body;
- a piston slidably disposed within the body and including a pushrod seat for contacting a pushrod;
- a seal located between the pushrod seat and the pushrod;
- a first fluid chamber located within the piston;
- a second fluid chamber defined by the body and the piston; and
- a fluid-directing insert located in the first fluid chamber,
- wherein the first fluid chamber is in fluid communication with the second fluid chamber,
- wherein the first fluid chamber is in fluid communication with the pushrod seat by way of a passage through the pushrod seat; and
- wherein the fluid-directing insert and the seal form a unitary structure.

* * * * *